US007134248B2

(12) United States Patent
Takagi et al.

(10) Patent No.: US 7,134,248 B2
(45) Date of Patent: Nov. 14, 2006

(54) PRE-CAST PANEL FORM INSERT

(75) Inventors: Kyozaburo Takagi, Centerville, OH (US); Gordon Charles Dodson, Lewis Center, OH (US)

(73) Assignee: Fukuvi USA, Inc., Huber Heights, OH (US)

( * ) Notice: Subject to any disclaimer, the term of this patent is extended or adjusted under 35 U.S.C. 154(b) by 479 days.

(21) Appl. No.: 10/408,756

(22) Filed: Apr. 7, 2003

(65) Prior Publication Data

US 2004/0079035 A1 Apr. 29, 2004

Related U.S. Application Data

(60) Provisional application No. 60/420,853, filed on Oct. 24, 2002.

(51) Int. Cl.
*E04B 1/70* (2006.01)

(52) U.S. Cl. ..... 52/302.3; 52/302.6; 249/2; 249/37; 249/128; 249/142

(58) Field of Classification Search ..... 52/58, 52/62, 94, 96, 254, 293.3, 302.3, 302.6, 101, 52/443, 517, 573.1, 720.1, 731.7, 169.14
See application file for complete search history.

(56) References Cited

U.S. PATENT DOCUMENTS 1,571,700 A * 2/1926 Burrell ..... 404/50
2,064,528 A * 12/1936 Fischer ..... 404/136
RE24,921 E * 6/1961 Wilbur ..... 404/51
4,127,352 A * 11/1978 Peters ..... 404/74
5,332,191 A * 7/1994 Nolan ..... 249/155
5,475,950 A * 12/1995 Palmer ..... 52/169.5
5,630,297 A * 5/1997 Rutherford ..... 52/58
5,979,123 A * 11/1999 Brockman ..... 52/101
6,026,622 A * 2/2000 Schmid ..... 52/396.02
6,134,847 A * 10/2000 Bifano et al. ..... 52/58
6,237,293 B1 * 5/2001 Gembala ..... 52/302.6
6,298,621 B1 * 10/2001 Lee ..... 52/302.6
6,421,971 B1 * 7/2002 Gembala ..... 52/302.6
6,470,638 B1 * 10/2002 Larson ..... 52/302.1
6,591,559 B1 * 7/2003 Contreras et al. ..... 52/101

* cited by examiner

*Primary Examiner*—Carl D. Friedman
*Assistant Examiner*—Yvonne M. Horton
(74) *Attorney, Agent, or Firm*—Dinsmore & Shohl LLP

(57) ABSTRACT

The present invention is directed to a pre-cast panel form insert used in precast construction. The insert comprises a substantially planar portion defining dimensions suitable to complement dimensions of a pre-cast panel form and a fluid diverting portion. The fluid diverting portion is configured to define a fluid-diverting recess in an edge face of a pre-cast panel bounded by a form including the form insert. The fluid diverting portion is configured such that said fluid diverting recess defines, a circular cross-sectional profile, or a multi-angular cross-sectional profile, that impedes the flow of water along said pre-cast panel edge face when said edge face assumes a substantially horizontal orientation.

44 Claims, 5 Drawing Sheets

PRE-CAST PANEL FORM INSERT

CROSS-REFERENCE TO RELATED APPLICATIONS

This application claims the benefit of U.S. Provisional Application Ser. No. 60/420,853, filed Oct. 24, 2002.

BACKGROUND

The present invention relates to the formation of panels, and more particularly to the formation of pre-cast construction panels for use in tilt-up and other pre-cast construction.

SUMMARY OF THE INVENTION

The present invention provides an insert and a method of making a wall panel that is constructed to allow fluid to drain off the building quickly and efficiently. The wall panels made using an insert according to the present invention, have a recess that diverts the flow of fluid running back or under an overhang. By diverting the flow of fluid in this manner, the fluid does not touch the side of the building, the doors, or the windows as the fluid drains, thereby extending the life of the wall panel and, in turn, the life of the building.

According to the present invention, a panel form insert having a fluid diverting portion is provided. When the fluid diverting portion is formed in the panel, the pathway of fluid is diverted and kept from running back or under an overhang.

DETAILED DESCRIPTION

Figure 1:
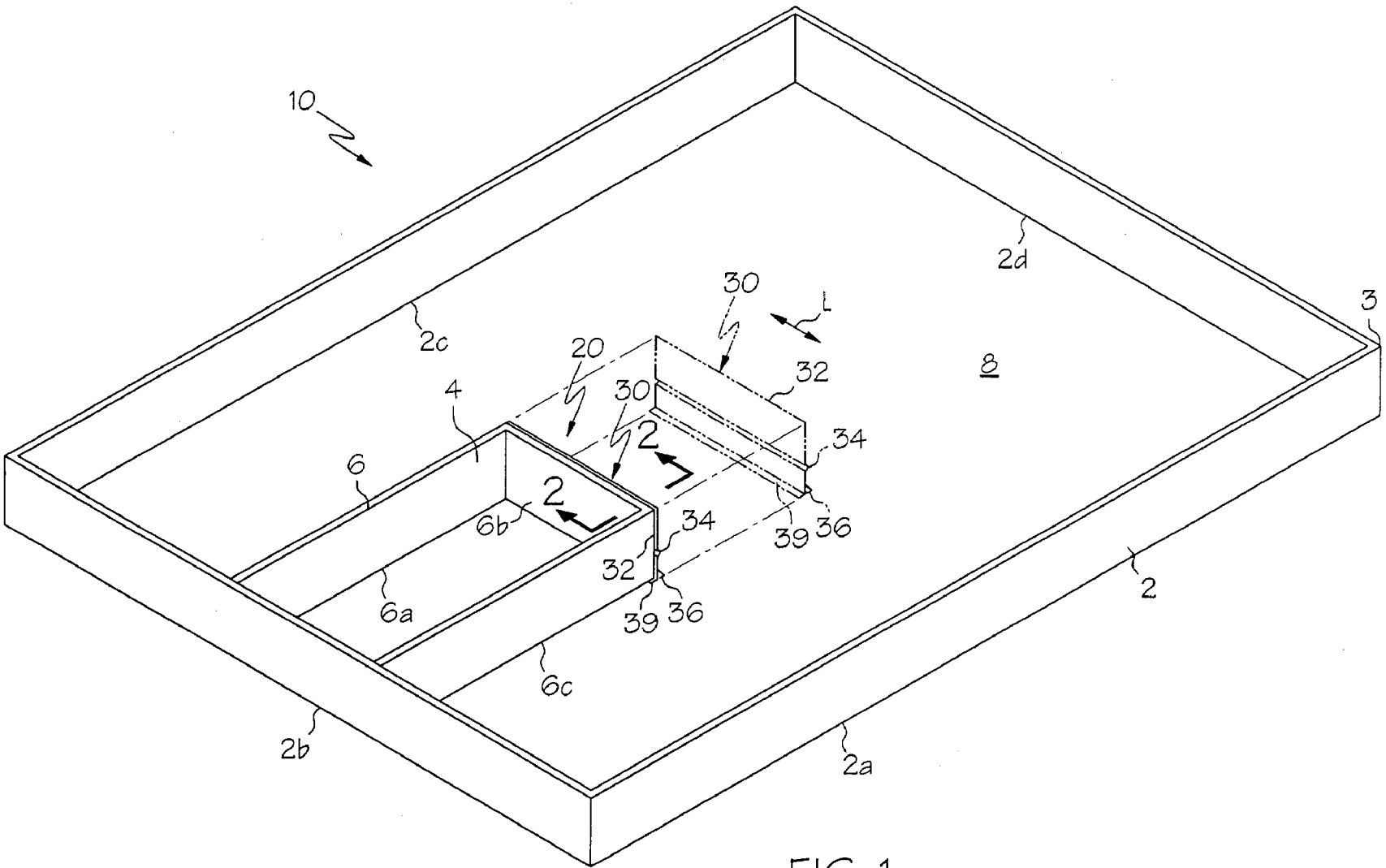
FIG. 1 is an illustration of a pre-cast panel form including an insert according to the present invention.

Referring to FIG. 1, a panel form 10 is shown. A casting material, e.g. concrete, is introduced into one panel form 10 and cured for use in the construction of commercial and industrial buildings by, for example, the tilt-up method. The panel form 10 comprises a panel frame 2 made of four panel frame members 2*a*, 2*b*, 2*c*, and 2*d*. The panel frame members 2*a*, 2*b*, 2*c*, and 2*d* form a rectangular shaped panel frame in FIG. 1, however, it is to be appreciated that any desired shape may be used. The panel frame members 2*a*, 2*b*, 2*c*, and 2*d* are placed onto a forming surface 8.

The forming surface can be a concrete slab, a smooth floor, or any surface capable of forming a flat, smooth, horizontal surface. The forming surface 8 is typically poured in place and then coated with a release agent for easier removal of the cured panel. The forming surface 8 can alternatively be referred to as a slab or casting surface. After the casting material is poured within the panel form 10, the top edges 3 of the panel form are used as a guide for a screed which forms a flat casting material surface. After the casting material is cured, the cured panel is lifted, tilted, or otherwise positioned for use.

The panel form 10 can be configured such that an opening 4 is formed in the panel. Within the panel frame 2 is an opening frame 6 formed by three opening frame members 6*a*, 6*b*, and 6*c*. The opening frame 6 distinguishes an area where the casting material is not to be poured and obstructs the flow the poured casting material into the opening 4. Therefore, once the wall panel is set, cured, and positioned for use, an open space exists in the wall panel to form a doorway, window, or the like.

The panel frame members 2*a*, 2*b*, 2*c*, and 2*d* and the opening frame members 6*a*, 6*b*, and 6*c* are typically made of wood, plastic, or other suitable materials. Although it is contemplated that a variety of dimensions may be suitable, the panel frame members 2*a*, 2*b*, 2*c*, and 2*d* can have a length dimension of at least about six feet (2 meters) with a height dimension of at least about 4 inches (10 cm). The opening frame members 6*a*, 6*b*, and 6*c* can have a height dimension of at least about 4 inches (10 cm) and a length dimension of at least about 24 inches (60 cm). The panel frame members 2*a*, 2*b*, 2*c*, and 2*d* and the opening frame members 6*a*, 6*b*, and 6*c* may be secured to the forming surface 8 by hardware, such as braces, clamps, nails, screws, adhesive, tapes, fasteners, or any other suitable means for securing a member to a forming surface.

Figure 2:
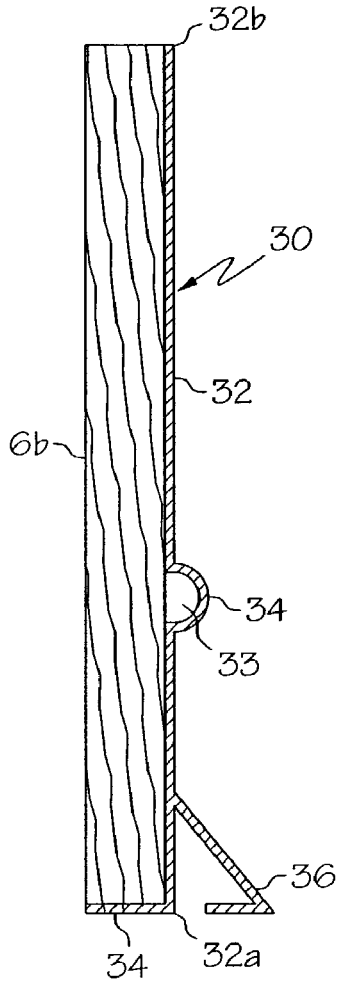
FIG. 2 is a cross-sectional view of a panel form insert according to one embodiment of the present invention.

Referring to FIGS. 1 and 2, a panel form insert 30 according to the present invention is positioned along the opening frame member 6*b*. The insert 30 is placed over a header portion 20 of the opening frame member 6*b* such that as the casting material is poured onto the forming surface 8, the casting material will cure with a profile defined by the insert 30. The insert 30 comprises a substantially planar portion 32 and a fluid diverting portion 34. The substantially planar portion 32 comprises first and second peripheral edges 32*a* and 32*b* that extend longitudinally from the substantially planar portion 32.

The substantially planar portion 32 of the insert 30 and the fluid diverting portion 34 are elongate along a lengthwise dimension L. Thus, the insert 30 rests lengthwise L over opening frame member 6*b*. The insert 30 is shown extending the entire length of the opening frame member 6*b*, however, the insert 30 does not have to extend the entire length of the opening frame member 6*b* but can extend any desired length.

The fluid diverting portion 34 protrudes from the substantially planar portion 32 such that the substantially planar portion 32 and the fluid diverting portion 34 form a monolithic structure. The fluid diverting portion 34 can be oriented generally parallel to one or both of the peripheral edges 32*a* and 32*b* of the substantially planar portion 32 and can extend along the lengthwise dimension L of the substantial planar portion 32. The fluid diverting portion 34 can be placed a substantial distance from either the first peripheral edge 32*a*, the second peripheral edge 32*b*, or the fluid diverting portion 34 may be disposed between the first and second peripheral edges 32*a* and 32*b*. The fluid diverting portion 34 may be disposed anywhere along the substantially planar portion 32 such that when the insert 30 is used to make a panel, the fluid diverting recess made in the panel by the fluid diverting portion 34 of the insert 30 prevents fluid, such as water, moving down a vertical face of a panel from reaching a window, door, or other partition in the opening 4 in the panel. The fluid diverting portion 34 extends along the lengthwise direction of the substantially planar portion 32 parallel to the longitudinal peripheral edges 32*a* and 32*b* of the substantially planar portion 32. The preferred position of the fluid diverting portion 34 relative to the front and back major faces of the panel depends upon the location of the window or door in the opening 4.

In the illustrated embodiment, the fluid diverting portion 34 decreases in cross section size from a maximum cross sectional dimension. Thus, a fluid diverting recess created by the fluid diverting portion 34 in an edge face of a cured panel decreases in cross sectional size from a maximum cross sectional dimension to a minimum cross sectional dimension at the terminal portion of the fluid diverting portion 34. The cross sectional dimension of the fluid diverting portion is sufficient to substantially impede the flow of fluid across the fluid diverting portion. More specifically, the size and profile of the fluid diverting recess is configured such that the fluid diverting recess will substantially impede fluid from touching a window or door placed in the opening 4 when the panel is in a vertical orientation.

Referring to FIG. 2, the fluid diverting portion 34 may be a recessed area, meaning that there is an open space 33 between the opening frame 6 member and the insert 30 at the location of the fluid diverting portion 34 of the insert. Alternatively, the fluid diverting portion 34 may be solid such that the fluid diverting portion is flush with the opening frame member 6*b*.

Figure 3D:
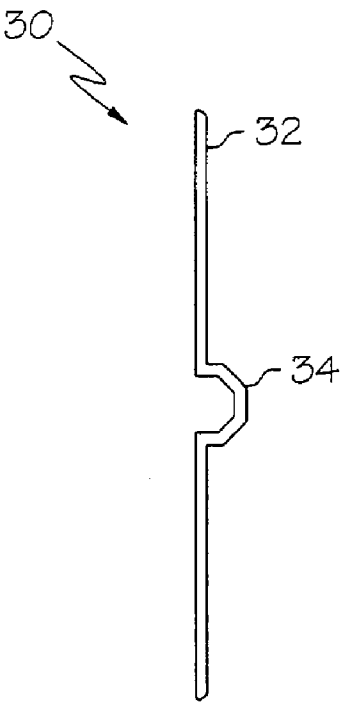
FIGS. 3*a*–3*d* are illustrations of panel form insert fluid diverting portions according to various alternative embodiments of the present invention.
Figure 3C:
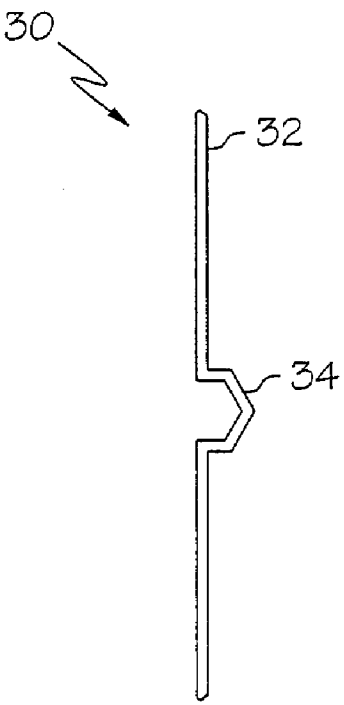
Figure 3B:
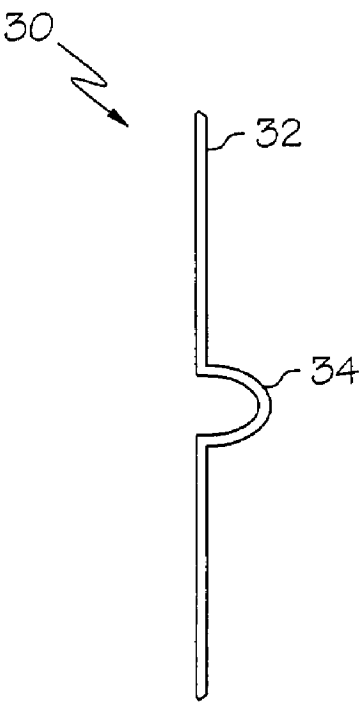
Figure 3A:
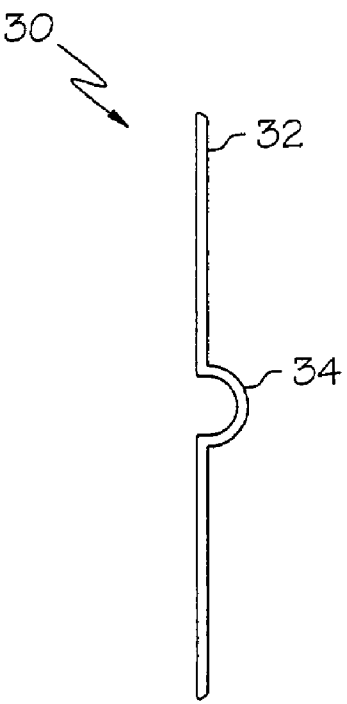

Referring to FIGS. 3*a*–3*b*, the cross-section of the fluid diverting portion 34 may be a variety of shapes that comprise a curved cross-sectional profile. FIG. 3*a* shows a fluid diverting portion 34 comprising a semicircular cross-section while FIG. 3*b* shows the fluid diverting portion 34 comprising an elliptical cross-section. Referring to FIGS. 3*c* and 3*d*, the fluid diverting portion 34 may be characterized by a multi-angular cross sectional profile. FIG. 3*c* shows a fluid diverting portion 34 comprising a hexagonal cross-section while FIG. 3*d* shows the fluid diverting portion 34 comprising an octagonal cross-section. It is to be appreciated that these shapes are merely examples of shapes that may form the fluid diverting portion 34 and that the fluid diverting portion 34 is not limited to these specific shapes.

Figure 4:
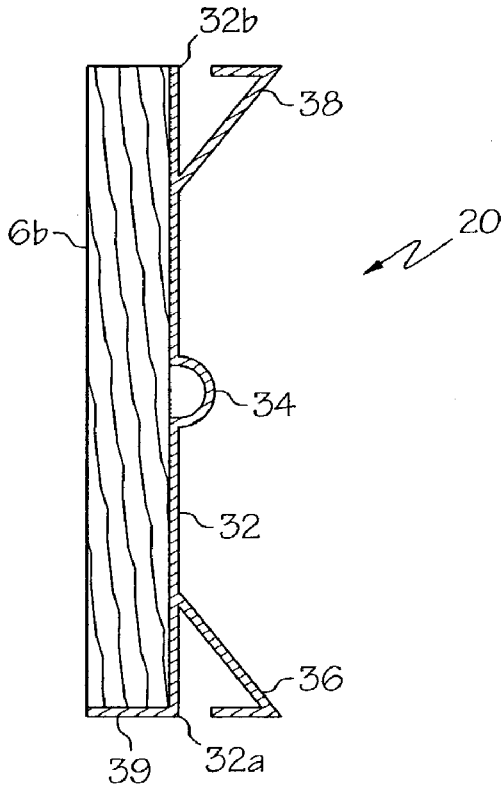
FIG. 4 is an illustration of a panel form insert according to the present invention having two integral chamfer portions.

The insert 30 may comprise a first chamfer portion 36. The first chamfer portion 36 is formed by a portion of the insert 30 that extends diagonally outward from the substantially planar portion 32. In one embodiment, the first chamfer portion 36 extends about 45° from the substantially planar portion 32. Once the insert 30 is removed from the panel, the panel displays a cut edge. As shown in FIG. 4, a second chamfer portion 38 can be integral with the substantially planar portion. Typically, the second chamfer portion 38 extends diagonally about 45° from the substantially planar portion 32.

Figure 5:
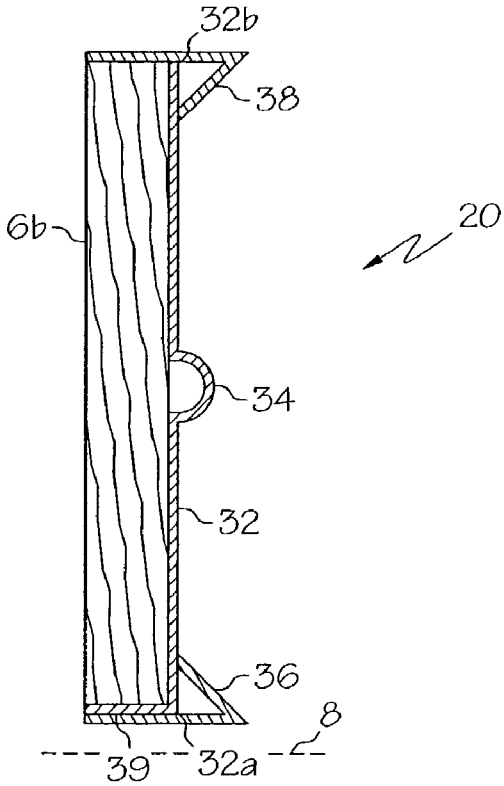
FIG. 5 is an illustration of a panel form insert according to the present invention having two separate chamfer portions.

As shown in FIG. 5, the first and second chamfer portions 36 and 38 may be separate from the substantially planar portion 32. Therefore, the first and second chamfer portions 36 and 38 may be placed between the panel forming surface 8 and the substantially planar portion 32 at the first peripheral edge 32*a*. At the second peripheral edge 32*b* of the substantially planar portion 32, the second chamfer 38 rests over the substantially planar portion 32.

Also shown in FIGS. 1 and 2, the insert 30 may also comprise an extension leg 39. The extension leg 39 extends from the substantially planar portion 32 at an angle of about 90°. The extension leg extends a sufficient distance to provide an insert mounting surface to mount the insert 30 to the forming surface 8. The extension leg 39 may act as a fastening device for the insert 30 by adhering, coupling, or fastening to the opening member 6*b* and/or the panel forming surface 8 in order to keep the insert 30 in place while the concrete is being poured.

The entire insert 30 is a one-piece member which may be extruded of a rigid or semi-rigid plastic material such as polyvinylchloride (PVC), high density polyethylene (HDPC), etc. The insert 30 may be formed by injection molding, or other suitable processes.

The substantially planar portion 32 and fluid diverting portion 34 have a rigidity sufficient to resist significant deformation and breakage under panel forming pressure. Therefore, the insert 30 can withstand the pressure of casting material, such as concrete, contacting and forming around the side substantially planar portion from which the fluid diverting portion 34 protrudes. By placing the insert 30 over the header portion 20 of opening frame member 6*b* the casting material will contact the insert 30. By having the fluid diverting portion 34 protrude from the substantially planar portion 32, as the casting material hardens around the insert 30, the casting material will have the indentation of the fluid diverting portion 34. If a chamfer portion 36 is included on the insert 30, the panel wall will also display a cut edge.

The insert 30 is coupled to a header portion 20 of the opening frame member 6*b* such that it is connected to and extends from the panel forming surface 8 at an angle of about 90°. Once the frame members and the insert 30 are in place, the casting material is poured onto the panel forming surface 8. The casting material is poured at a depth to that allows for the desired thickness of the wall panel. It is to be appreciated that while the insert 30 is explained as being placed over opening frame member 6*b*, the insert 30 can be placed over any member where a fluid diverting portion 34 is desired in a panel wall. The insert 30 may be attached to the panel forming surface 8 by an adhesive, tape, hardware, such as nails, screws, suitable fasteners, or any other suitable means for securing and the insert to the slab. Alternatively, the insert 30 can simply rest upon panel forming surface 8, secured by the weight of the header portion 20. The adhesive can be any conventional adhesive suitable for securing a plastic member to a concrete surface. The extension leg 39 may comprise a groove into which hardware can be placed to fasten the insert 30 to the panel forming surface 8.

Figure 6:
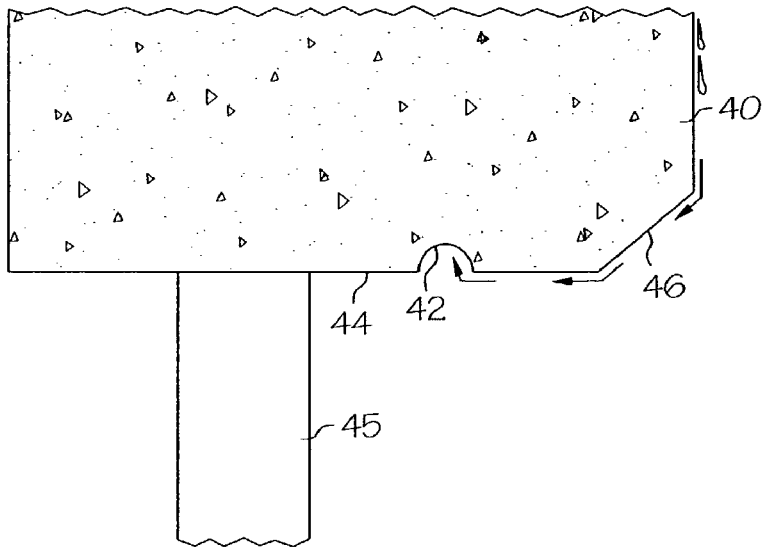
FIG. 6 is an illustration of a formed panel according to the present invention having a recessed fluid diverting portion and a chamfered edge.

Referring to FIG. 6, once the panel 40 is lifted vertically or otherwise positioned into place, the insert (not shown) can be stripped from the concrete wall panel 40. A fluid diverting recess 42 is formed in the panel 40 that is the shape of the fluid diverting portion of the insert. The recess 42 acts as a drip edge to help prevent fluid from running back or under an overhang of a vertically-oriented panel. A chamfered edge 46 is also shown, however, it is to be appreciated that a chamfered edge 46 does not have to be included on the panel 40. The arrows indicate the path of fluid running down the panel 40. The water follows the chamfered edge 46 of the panel and flows to the recess 42 of the panel 40. Once the water reaches the recess 42, all of the water, or a substantial portion of the water, is prevented from reaching the door 45 or any other portion of the overhang 44. The recess 42 thereby obstructs the path of the water.

Figure 7:
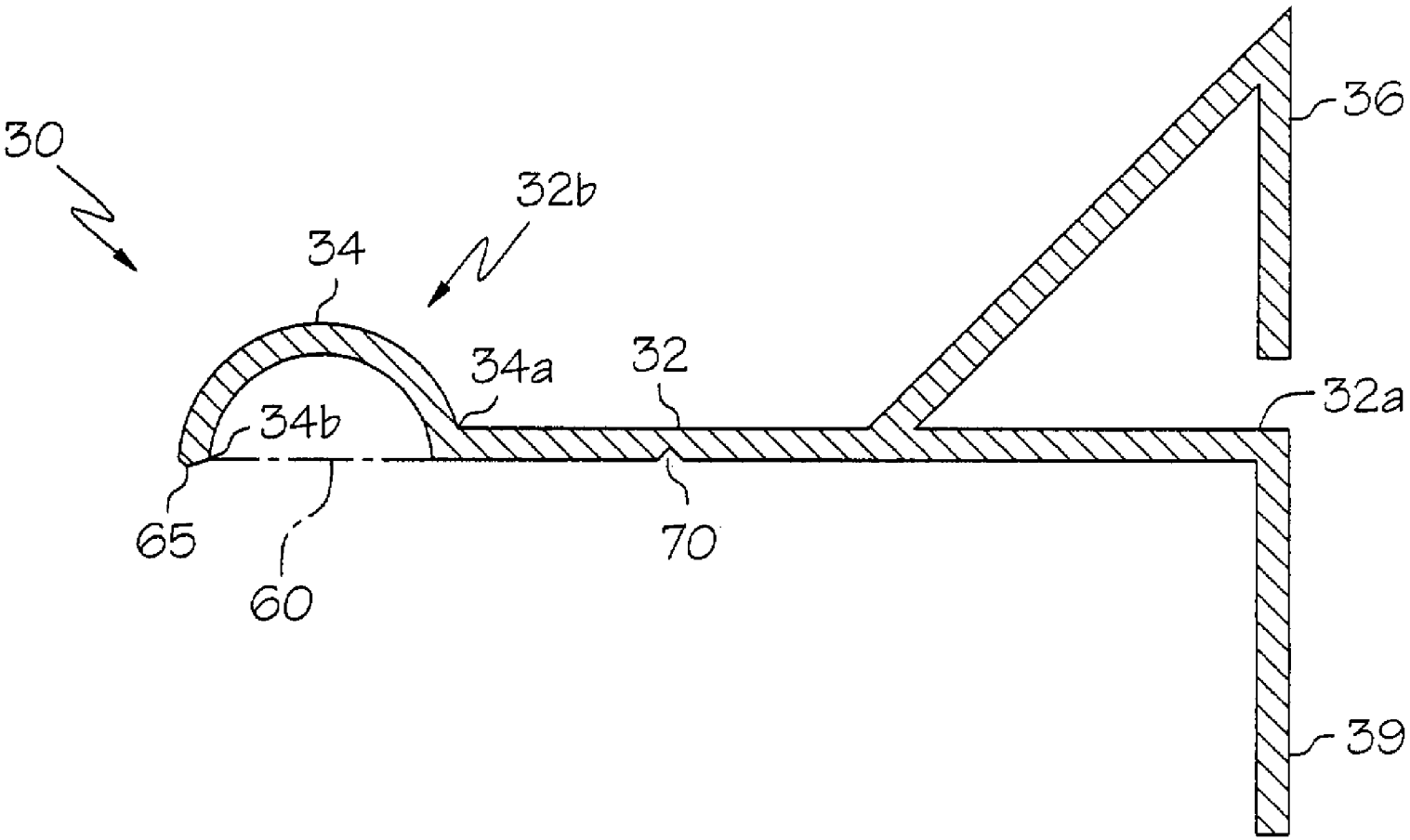
FIG. 7 is an illustration of a portion of a panel form insert according to the present invention having a sealing edge and a longitudinal area of weakness.

Referring to FIG. 7, another embodiment of the present invention is shown. The fluid diverting portion 34 extends from the second peripheral edge 32*b* of the substantially planar portion 32. The fluid diverting portion 34 has a beginning point 34*a* and a terminating point 34*b*. At the beginning point 34*a*, the fluid diverting portion 34 protrudes from said substantially planar portion 32 and extends to a terminating point 34*b*. A sealing edge 65 extends from the terminating point 34*b*. The sealing edge 65 extends across a plane 60 defined by substantially planar portion 32 such that the sealing edge 65 hangs below said substantially planar portion 32. In this manner, a secure seal may be established between the sealing edge 65 and the panel forming surface.

Referring again to FIG. 7, the substantially planar portion 32 may comprise a longitudinal area of weakness 70. The longitudinal area of weakness 70 is shown disposed between the first peripheral edge 32*a* and the fluid diverting portion 34. However, the longitudinal area of weakness 70 can be disposed anywhere along the substantially planar portion 32. The longitudinal area of weakness 70 can be anything that causes a weak area in the substantially planar portion 32. For example, the longitudinal area of weakness 70 may comprise a reduced thickness portion of the substantially planar portion 32 as shown in FIG. 8. The longitudinal area of weakness 70 may comprise a different, more brittle material that is extruded with the substantially planar portion. One example of a longitudinal area of weakness 70 is a score line. By providing a longitudinal area of weakness 70, the substantially planar portion 32 can be broken off, or a portion of the substantially planar portion 32 can be detached.

Having described the invention in detail and by reference to preferred embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A panel form comprising a panel frame, an opening frame, and a panel form insert, wherein:

said panel frame is configured to contain casting material within said panel frame;

said opening frame is configured to define an area within said panel frame that is free of casting material;

said panel form insert abuts a portion of said opening frame so as to permit casting material within said panel frame to cure with a profile defined by said panel form insert;

said panel form insert comprises a substantially planar portion and a fluid diverting portion;

said fluid diverting portion is configured to protrude from said substantially planar portion;

said fluid diverting portion is characterized by a curved cross sectional profile; and said substantially planar portion is characterized by a first peripheral edge and a second peripheral edge extending longitudinally along said substantially planar portion.

2. A panel form as claimed in claim 1, wherein said fluid diverting portion is characterized by a semi-circular cross-section.

3. A panel form as claimed in claim 1, wherein said fluid diverting portion is characterized by an elliptical cross-section.

4. A panel form as claimed in claim 1, wherein said fluid diverting portion creates a recessed area in said substantial planar portion.

5. A panel form as claimed in claim 1, wherein said fluid diverting portion is configured to define a fluid diverting recess in an edge face of a pre-cast panel bounded by a form including said form insert.

6. A panel form as claimed in claim 1, wherein said fluid diverting portion decreases in cross sectional size from a maximum cross sectional dimension.

7. A panel form insert as claimed in claim 1 wherein said fluid diverting portion comprises a cross sectional dimension sufficient to substantially impede the flow of fluid across said fluid diverting portion.

8. A panel form as claimed in claim 1, wherein said fluid diverting portion is displaced a substantial distance from said first peripheral edge of said substantially planar portion.

9. A panel form as claimed in claim 1, wherein said fluid diverting portion is displaced a substantial distance from said second peripheral edge of said substantially planar portion.

10. A panel form as claimed in claim 1, wherein said fluid diverting portion is disposed between said first peripheral edge and said second peripheral edge of said substantially planar portion.

11. A panel form as claimed in claim 1, wherein said fluid diverting portion is oriented generally parallel to said first and second peripheral edges.

12. A panel form as claimed in claim 1, wherein said fluid diverting portion protrudes from said substantially planar portion along said second peripheral edge.

13. A panel form as claimed in claim 12, wherein said fluid diverting portion protrudes from said substantially planar portion along said second peripheral edge at a beginning point of said fluid diverting portion.

14. A panel form as claimed in claim 13, wherein said fluid diverting portion extends from said beginning point to a terminating point.

15. A panel form as claimed in claim 12, wherein said fluid diverting portion further comprises a sealing edge extending along said second peripheral edge.

16. A panel form as claimed in claim 15, wherein said sealing edge is defined at a terminating end of said fluid diverting portion.

17. A panel form as claimed in claim 15, wherein said sealing edge extends across a plane defined by substantially planar portion.

18. A panel form as claimed in claim 1, wherein said substantially planar portion further comprises a longitudinal area of weakness.

19. A panel form as claimed in claim 18, wherein said longitudinal area of weakness is disposed between said second peripheral edge and said fluid diverting portion.

20. A panel form as claimed in claim 18, wherein said longitudinal area of weakness comprises a reduced thickness portion of said substantially planar portion.

21. A panel form as claimed in claim 18, wherein said longitudinal area of weakness comprises a score line.

22. A panel form as claimed in claim 18, wherein said longitudinal area of weakness comprises a brittle material.

23. A panel form as claimed in claim 1, wherein said substantially planar portion and said fluid diverting portion define at least a portion of a monolithic structure of said insert.

24. A panel form as claimed in claim 1, wherein said fluid diverting portion is characterized by a rigidity sufficient to resist significant deformation and breakage under a panel forming pressure.

25. A panel form as claimed in claim 1, wherein said substantially planar portion is elongated along a lengthwise dimension.

26. A panel form as claimed in claim 25, wherein said fluid diverting portion extends along said lengthwise dimension of said substantially planar portion.

27. A panel form as claimed in claim 25, wherein said fluid diverting portion extends along said lengthwise direction of said substantially planar portion parallel to a longitudinal peripheral edge of said substantially planar portion.

28. A panel form as claimed in claim 1, wherein said insert further comprises a chamfer portion.

29. A panel form as claimed in claim 28, wherein said chamfer portion is integral with said substantially planar portion.

30. A panel form as claimed in claim 28, wherein said chamfer portion is separate from said substantially planar portion.

31. A panel form as claimed in claim 1, wherein said substantially planar portion further comprises an extension leg extending from an end portion of said substantially planar portion.

32. A panel form as claimed in claim 1, wherein said extension leg extends from said substantially planar portion at an angle of about 90°.

33. A panel form as claimed in claim 1, wherein said extension leg extends a sufficient distance to provide an insert mounting surface.

34. A panel form as claimed in claim 1, wherein said insert further comprises a first chamfer at said first peripheral edge of said substantially planar portion and a second chamfer at said second peripheral edge of said substantially planar portion.

35. A panel form as claimed in claim 34, wherein said first and said second chamfers are integral to said substantially planar portion.

36. A panel form as claimed in claim 34, wherein said first and said second chamfers are separate from said substantially planar portion.

37. A panel form as claimed in claim 34, wherein said second chamfer is integral to said substantially planar portion.

38. A panel form as claimed in claim 34, wherein said second chamfer is separate from said substantially planar portion.

39. A panel form comprising a panel frame, an opening frame, and a panel form insert, wherein:

said panel frame is configured to contain casting material within said panel frame;

said opening frame is configured to define an area within said panel frame that is free of casting material;

said panel form insert abuts a portion of said opening frame so as to permit casting material within said panel frame to cure with a profile defined by said panel form insert;

said panel form insert comprises a substantially planar portion and a fluid diverting portion;

said substantially planar portion is characterized by a first peripheral edge and a second peripheral edge extending longitudinally along said substantially planar portion;

said fluid diverting portion is configured to protrude from said substantially planar portion;

said fluid diverting portion is configured to define a fluid diverting recess in an edge face of a pre-cast panel bounded by said panel frame including said panel form insert;

said fluid diverting portion is configured such that said fluid diverting recess defines a curved cross-sectional profile; and said fluid diverting portion is configured such that said curved cross-sectional profile is configured to substantially impede the flow of water along said pre-cast panel edge face when said edge face assumes a substantially horizontal orientation.

40. A panel form as claimed in claim 39, wherein said panel form defines a height dimension of at least about 4 inches (10 cm).

41. A panel form as claimed in claim 39, wherein said panel form defines a length dimension of at least about 24 inches (60 cm).

42. A panel form as claimed in claim 39, wherein said fluid diverting portion decreases in cross sectional size from a maximum cross sectional dimension along said edge face to a minimum cross sectional dimension at a terminal portion of said fluid diverting recess.

43. A panel form as claimed in claim 39, wherein said fluid diverting portion comprises a cross sectional dimension sufficient to substantially impede the flow of fluid.

44. A method of forming a pre-cast wall panel for tilt-up construction, said method comprising:

affixing a form to a casting surface;

configuring said form to define a panel with an opening;

coupling an insert to said form at a position corresponding to a header portion of said opening, said insert comprising a substantially planar portion and a fluid diverting portion, wherein:

said fluid diverting portion is configured to protrude from said substantially planar portion, and said fluid diverting portion is characterized by a curved or multi-angular cross-sectional profile;

pouring casting material into said form including said insert;

curing said casting material to form a cured panel; and removing said panel from said form.

* * * * *

UNITED STATES PATENT AND TRADEMARK OFFICE

CERTIFICATE OF CORRECTION

PATENT NO. : 7,134,248 B2
APPLICATION NO. : 10/408756
DATED : November 14, 2006
INVENTOR(S) : Takagi et al.

It is certified that error appears in the above-identified patent and that said Letters Patent is hereby corrected as shown below:

Col. 6, line 8 "A panel form insert as claimed in claim 1" should read --A panel form as claimed in claim 1,--

Signed and Sealed this

First Day of May, 2007

JON W. DUDAS
*Director of the United States Patent and Trademark Office*